US005394581A

United States Patent [19]

Leoutsakos

[11] Patent Number: 5,394,581

[45] Date of Patent: Mar. 7, 1995

[54] MANUAL SUPPORT APPARATUS

[76] Inventor: Thomas Leoutsakos, 19 Lafayette St., Randolph, Mass. 02368

[21] Appl. No.: 133,632

[22] Filed: Oct. 7, 1993

[51] Int. Cl.[6] ..... A47C 21/00

[52] U.S. Cl. ..... 5/662; 5/503.1; 5/425; 403/251

[58] Field of Search ..... 5/425, 428, 6, 430, 5/503.1, 658, 662; 403/256, 257, 261, 338; 248/225.31, 228

[56] References Cited

U.S. PATENT DOCUMENTS

| | | | |
|---|---|---|---|
| 1,797,847 | 3/1931 | Vandagriff . | |
| 2,593,567 | 9/1952 | Keck | 211/86 |
| 2,712,137 | 7/1955 | Hunter | 5/131 |
| 2,817,855 | 12/1957 | Pratt | 5/430 |
| 2,929,078 | 3/1960 | Smith et al. | 5/331 |
| 3,173,158 | 3/1965 | Oakes | 5/425 |
| 3,179,957 | 4/1985 | Norton | 5/428 |
| 3,248,744 | 5/1966 | Hutt | 5/429 |
| 3,863,282 | 2/1975 | Stillwell | 5/317 B |
| 4,334,330 | 6/1982 | Marshall | 4/480 |
| 4,676,687 | 6/1987 | Koffler | 5/425 |
| 4,836,523 | 6/1989 | Englander | 269/328 |
| 4,932,090 | 6/1990 | Johansson | 5/445 |
| 5,121,516 | 6/1992 | Jones | 5/658 |
| 5,231,721 | 8/1993 | Fish | 5/662 |

*Primary Examiner*—Michael F. Trettel
*Attorney, Agent, or Firm*—Wolf, Greenfield & Sacks

[57] ABSTRACT

A manual support apparatus attachable to a bedframe. The manual support device includes a support tube having at least two legs, and at least two fastening members which are adapted for attachment to the bedframe. The fastening members are secured to the support tube legs. In another embodiment, the manual support apparatus includes a support tube without separate leg portions, wherein the fastening members are secured to support tube body. At least two means for attaching the fastening members to the bedframe are provided. The support tube is shaped to conform to at least one corner of the bedframe. The apparatus provides a secure and stable method for a user/patient to transfer into and out of bed, particularly hospital beds, independently and enhance in-bed mobility.

18 Claims, 5 Drawing Sheets

MANUAL SUPPORT APPARATUS

BACKGROUND OF THE INVENTION

1. Field of the Invention

The present invention pertains to a manual support apparatus and, more particularly, to a manual support apparatus attachable to hospital bedframes to assist user's in transferring into and out of bed, as well as with in-bed mobility.

2. Description of the Prior Art

Transferring into and out of bed as well as maneuvering in bed, particularly a hospital bed, may be a difficult process for some elderly or disabled persons.

Typical hospital beds provide little or no additional manual support to assist people to gain their balance while transferring into or out of the bed, or help them to adjust their in-bed posture. Particularly at risk of falling, are acute or chronic term patients, in the home or hospital environment, which require assistance maneuvering into and about a bed. A wheelchair user, for example, may find it difficult to transfer into and out of bed without assistance. These patients require a secure and stable method to transfer into and out of bed independently. It would be useful, therefore, to provide an apparatus for manual support.

While various home care and hospital beds have been available in the prior art, these beds are generally expensive. In addition, these beds generally provide only full side rails which can be raised to prevent patients from falling out of bed. These side rails do not assist the user in transferring into or out of bed, or with in-bed mobility, as they are lowered prior to transfers. Furthermore, a patient may require additional support for only a temporary period and, therefore, would not require assistance from health aides, family or hospital staff if an existing bed can be modified.

It is therefore an object of this invention to provide a manual support apparatus, which is attachable to a bedframe, particularly a hospital bedframe, for providing a secure and stable method to transfer into and out of bed independently, and improve in-bed mobility.

A further object of the invention is to provide a manual support apparatus, which is attachable to a bedframe, which can be easily assembled and disassembled, as well as quickly installed on any side/corner of a bed.

SUMMARY OF THE INVENTION

Accordingly, the present invention provides a manual support apparatus attachable to a bedframe. The manual support apparatus includes a support tube having at least two legs and at least two fastening members secured to the support tube legs. The fastening members are adapted for attachment to the bedframe, and means are provided for attaching the fastening member to the bedframe. The support tube is shaped to conform to at least one corner of the bedframe.

In another embodiment, the manual support apparatus of the present invention includes a support tube having at least two portions. Each of the portions are adapted for assembly with each other, such that the support tube has at least two legs. At least two fastening members are included, and are secured to each support tube leg. The fastening members are adapted for attachment to the bedframe, and means are provided for attaching the fastening member to the bedframe. The support tube, when assembled, is shaped to conform to at least one corner of the bedframe.

In a further embodiment of the present invention, the manual support apparatus includes a support tube, shaped to conform to at least one corner of a bedframe, without separate leg portions. In this embodiment, the fastening members are secured directly to the support tube body.

The manual support apparatus can be attached to a hospital bedframe, in which a portion of the frame can be raised for patient comfort. The manual support apparatus can be attached to the movable frame portion of the hospital bedframe.

Other objects and features of the present invention will become apparent from the following detailed description, when taken in connection with the accompanying drawings which disclose a preferred embodiment of the invention. It is to be understood that the drawings are designed for the purpose of illustration only and are not intended as a definition of the limits of the invention.

BRIEF DESCRIPTION OF THE DRAWINGS

The foregoing and other objects and advantages of the invention will be appreciated more fully from the following drawings in which.

DETAILED DESCRIPTION OF THE INVENTION

Figure 1:
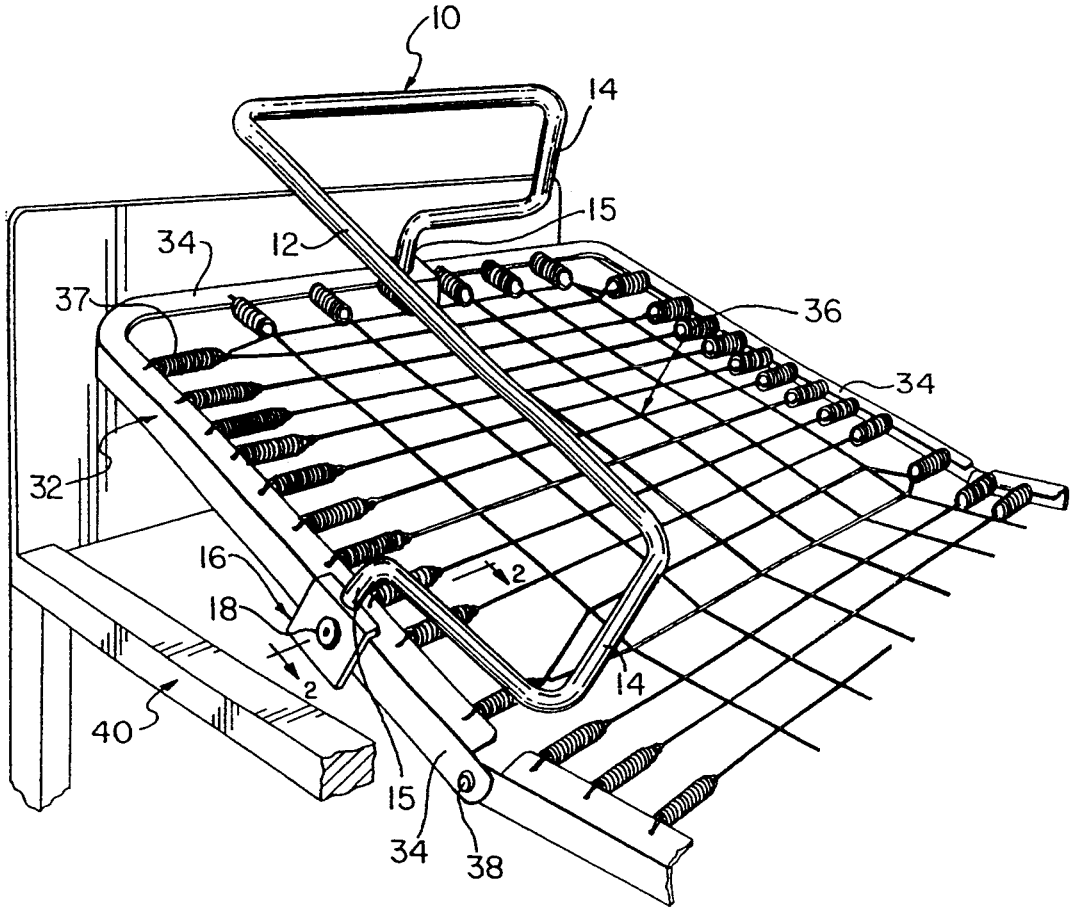
FIG. 1 is a perspective view of one embodiment of the manual support apparatus of the present invention attached to a bedframe.

Turning now to the Figures, wherein like reference numerals indicate like elements, FIG. 1 illustrates one embodiment of the manual support apparatus of the present invention. The manual support apparatus 10 may be easily installed on a typical bedframe or, preferably, a hospital bedframe to provide users with a secure and stable side and behind-the-head handle for transferring into and out of bed independently while enhancing in-bed mobility.

FIG. 1 shows a first embodiment of the manual support apparatus 10 of the present invention. Apparatus 10 includes support tube 12 having two legs 14 and fastening members 16. Fastening members 16 are secured to support tube legs 14 at ends 15, and are adapted for attachment to a bedframe, as described below. Support tube 12 is shaped to conform to at least one corner of bedframe 32.

Generally, bedframes 32 are rectangular in shape, and comprise a pair of end and side rails 34. Some bedframes, such as hospital bedframes (as shown), include a woven spring surface 36 to support a mattress (not shown). Spring surface 36 includes individual springs 37 connected to side and end rails 34. Hospital-type bedframes are generally adjustable, in which a portion of frame 32 can be raised at pivot 38 for user comfort. Typically, an outer frame 40 is used with the hospital-type bedframe. Support tube 12 is shown attached to bedframe 32 by fastening member 16. A similar arrangement is provided on the opposite side of support tube 12 (not shown). Fastening member 16 includes a clip and bolt (not shown). To adjust, install, or remove fastening member 16, a securing knob 18 is used which is mated with the bolt to provide a secure attachment. Knob 18 also provides a large grip surface to make installation/-removal easier for hospital staff or health care providers.

Figure 1A:
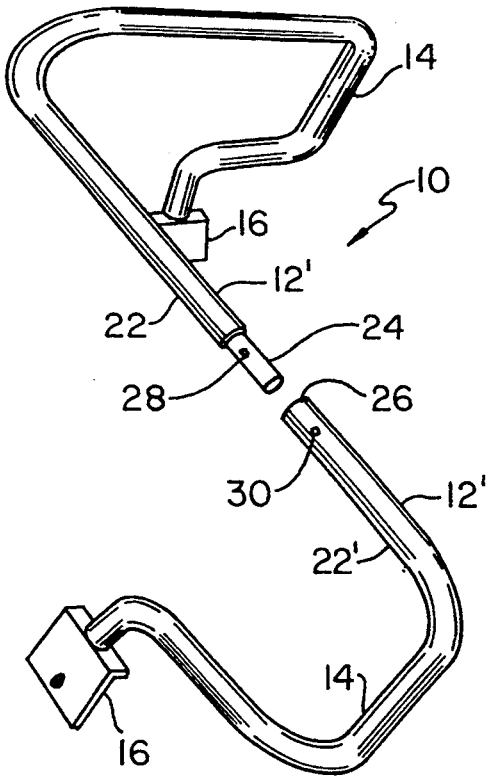
FIG. 1A is a perspective view of the apparatus of the present invention, wherein the support tube includes two portions.

FIG. 1A illustrates an alternative embodiment of manual support apparatus 10 which includes a support tube 12' having two portions 22, 22' which are adapted for assembly with each other. Each portion 22, 22' includes a leg 14, to which fastening member 16 is secured, as described above. Support tube 12' first portion 22 has a reduced cross-sectional diameter at end portion 24 which can be fit into bore 26 of support tube portion 22'. The end 24 of support tube portion 22 includes a projection 28, which is spring-fit in place and pressed into portion 22 when end 24 is placed into bore 26. Projection 28 provides a locking mechanism when it is snap-fit into hole 30, when portion 22 is assembled with portion 22'. In addition, projection 28 provides a simple means to interchange a wide variety of shapes and sizes of support tube portions (22 or 22'). A support tube having multiple, separable portions allows for easier packaging for a wholesaler/retailer, as well as reducing the storage space required when apparatus 10 is not in use. It is noted that support tube 12' can be made from a plurality of portions, which are adapted for assembly with each other. A variety of support tube shapes and sizes are possible when apparatus 10 is assembled. For example, extension tubes (not shown) and/or a variety of sized/shaped portions (22 or 22') can be used. When assembled, however, support tube 12' has at least two legs 14 for secure attachment to a bedframe.

Support tube 12 (12') is typically made from a rigid, durable material such as a hard plastic or metal. Preferably, support tube 12 is made from steel pipe; more preferably, support tube 12 is made from aluminum tubing due to its light weight and relative low cost. When used in hospital environments support tube 12 is most preferably made of stainless steel tubing due to its strength and durability. The outside diameter of support tube 12 is wide enough to provide support and narrow enough to be easily grasped by a user/patient. Typically, the outside diameter of support tube 12 is between about ½ inch and about 3 inches. Preferably, the diameter is between about ¾ inch and about 1 inch. It is noted that top portion of support tube 12 may be knurled and/or padded to provide a more secure grip and/or added user comfort.

Support tube legs 14 can be rigidly or removably secured to fastening members 16 at ends 15. Support tube legs 14 can be secured to fastening members in any manner known to those of skill in the art, such as welded, adhesively bonded, screw-fit, snap-fit, or the like. Preferably, support tube legs 14 are welded to fastening members 16 at ends 15 to provide a safe, rigid, attachment which can support the force and weight of a user/patient when pulling and/or resting on apparatus 10.

Figure 2:
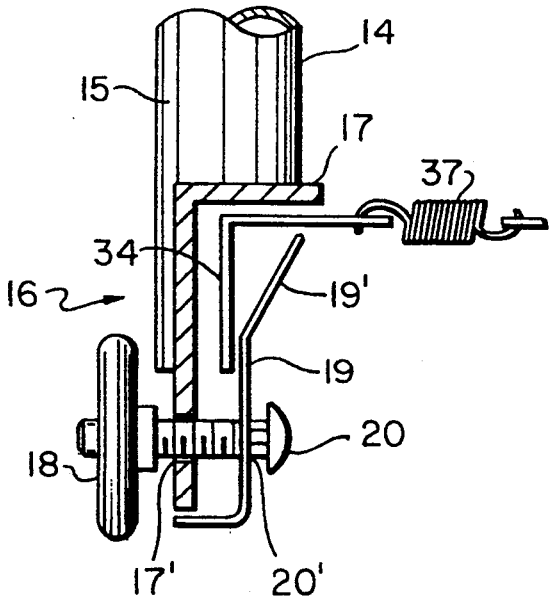
FIG. 2 is a cross-sectional side view, taken along section line 2—2 of FIG. 1, of a means for attaching the fastening member to the bedframe.

As noted, fastening members 16 can be removably attached to bedframe 32 (side and end rails 34) by means of an assembly including a clip, bolt and securing knob. Other means known to those of skill in the art, including a variety of alternative clips, snaps, clamps, or the like, can be used to removably attach fastening members 16 to bedframe 32. FIG. 2 shows primary clip 17, shaped to conform to the shape of a typical bedframe side rail 34, and backing clip 19, which are preferred due to their relative sturdy fit, inexpensive cost, and easy manual installation. Likewise, other means known to those of skill in the art can be used to attach the fastening member 16 to the bedframe 32, such as a pin, clamp, or the like. Bolt 20 and securing knob 18 provide users with an easy to secure, or loosen, assembly that is both inexpensive and safe.

FIG. 2 shows a partial cross-section of fastening means 16, taken along section line 2—2 of FIG. 1. Leg 14 is shown secured to fastening member 16 at end 15. Fastening member 16 includes a primary clip 17, which is generally an L-shaped clip for conforming with a similarly shaped side or end rail 34 of the bedframe. A backing clip 19 is provided with a bevelled portion 19' for creating a slot wherein bedframe rail portion 34 is secured. Backing clip 19 also includes a hole 20' which is positioned to correspond with primary clip hole 17'. In operation, (after the rail 34 is secured between the primary clip 17 and the backing clip 19) bolt 20 is placed through the aligned holes 17', 20' and is mated with securing knob 18.

Figure 3:
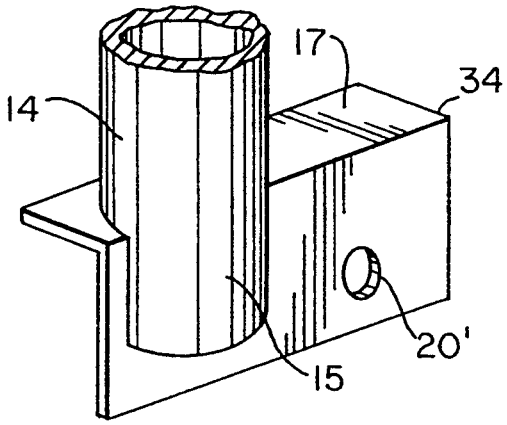
FIG. 3 is a perspective view of the fastening member secured to the support tube leg.

FIG. 3 shows a perspective view of fastening member primary clip 17 secured to support tube leg 14. As noted above, primary clip 17 is shaped to conform with side or end rail 34. Preferably, primary clip 17 is welded to support tube leg 14 at end 15 to provide a sturdy attachment which can support a user/patient while transferring in and out of bed or during in-bed movement. Primary clip 17 also includes hole 20' for receipt of means for attaching the fastening member to the bedframe. As noted above, the means for attaching preferably include a bolt, backing clip and securing knob; however, other means known to those of skill in the art can be used for this purpose.

Figure 4:
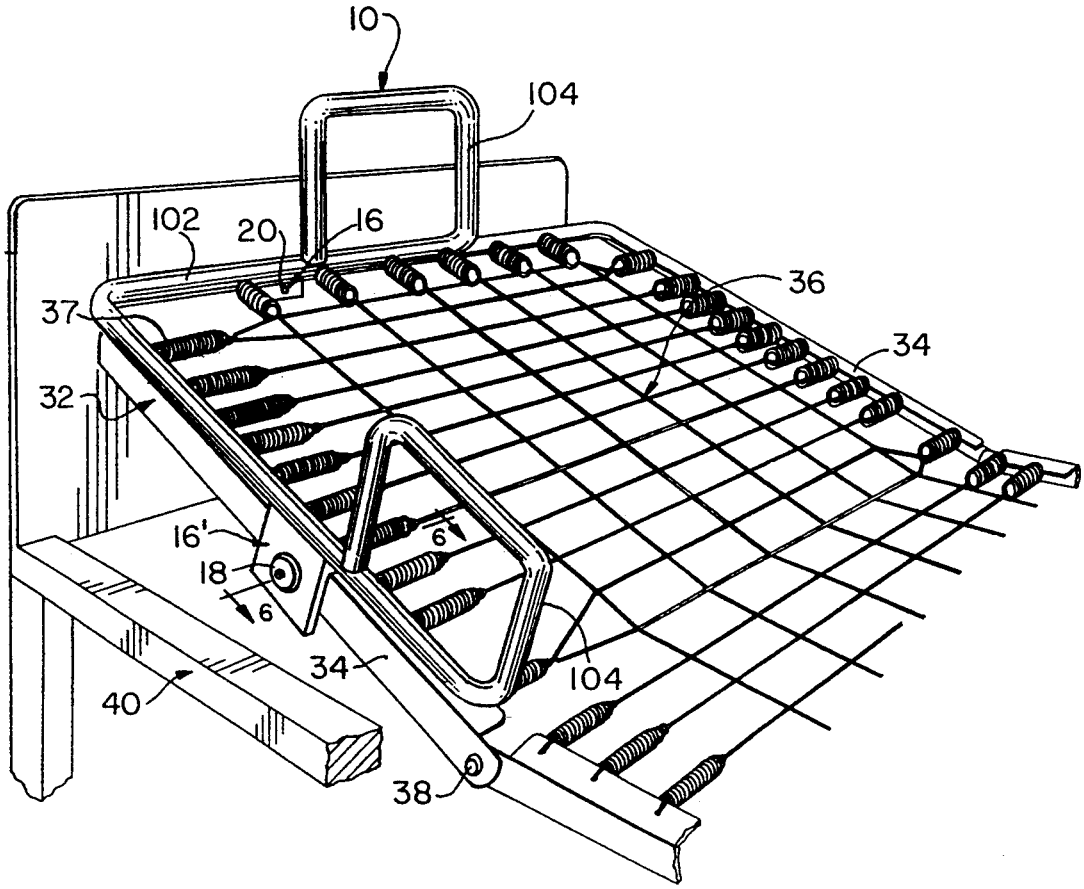
FIG. 4 is a perspective view of an alternative embodiment of the apparatus of the present invention attached to a bedframe.
Figure 5:
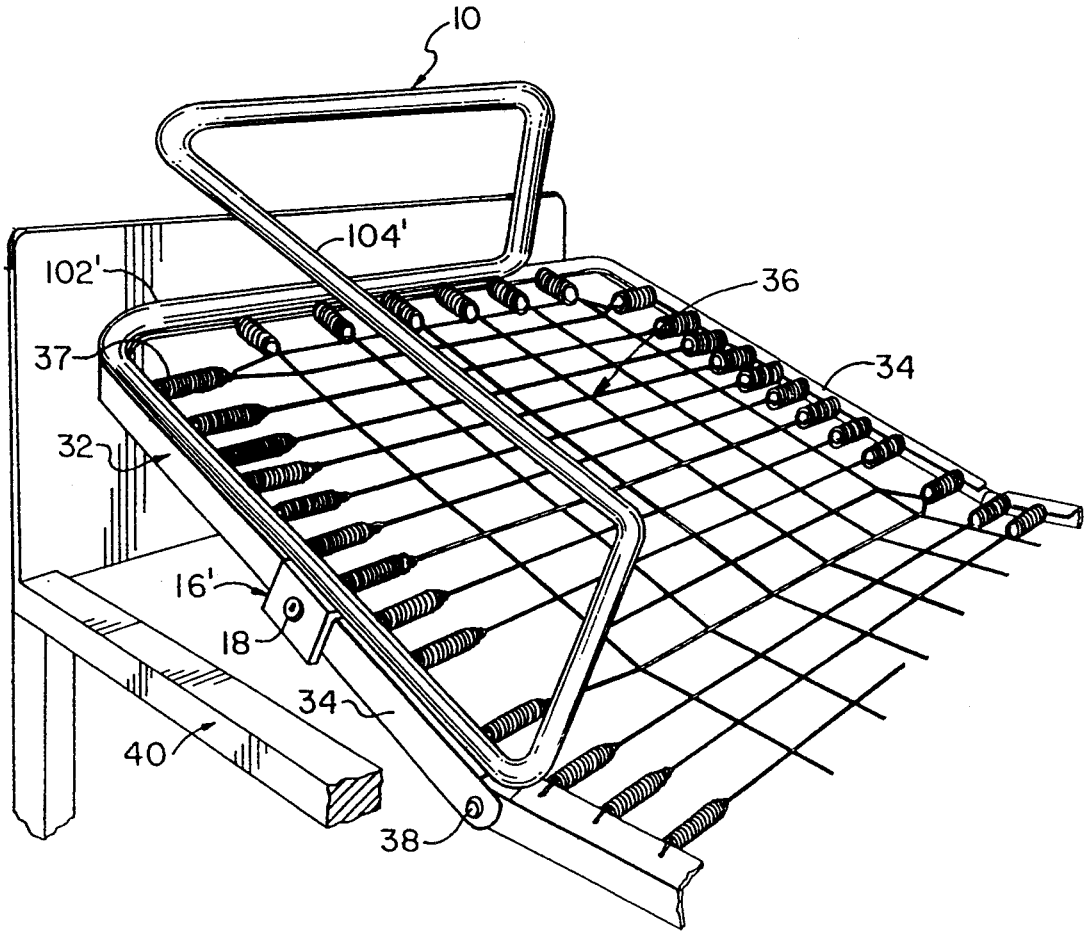
FIG. 5 is a perspective view of another embodiment of the present invention attached to a bedframe.
Figure 6:
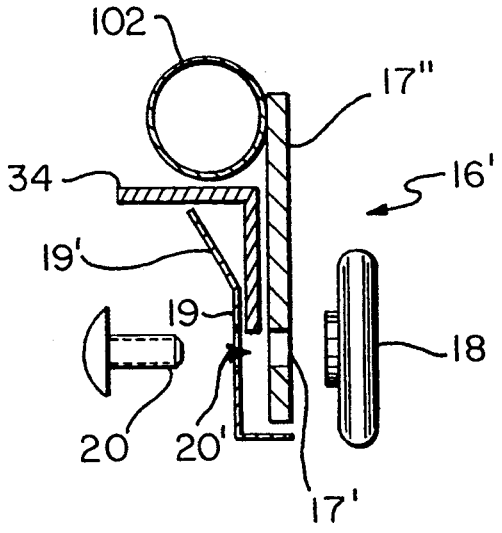
FIG. 6 is a cross-sectional side view, taken along section line 6—6 of FIG. 5, of a means for attaching the fastening member to the bedframe.
Figure 7:
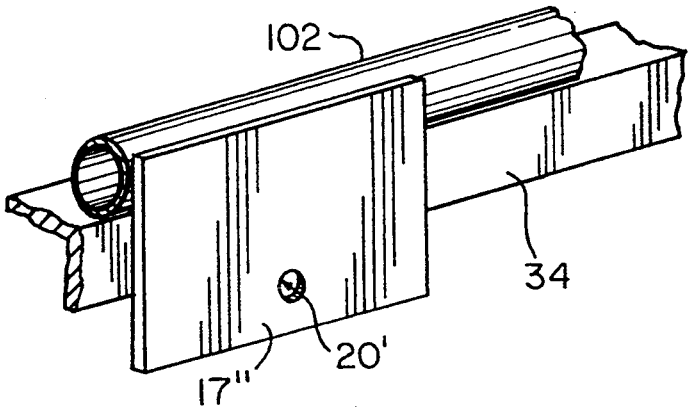
FIG. 7 is a perspective view of the fastening member secured to the support tube body.

Turning now to FIGS. 4 and 5, perspective views of alternative embodiments of the manual support apparatus 10 are shown. In FIG. 4, a support tube 102 (102' in FIG. 5) is provided and is shaped to conform to at least one corner of bedframe 32. Fastening member 16' is secured to the support tube 102 (102') main body portion, and is used to attach the support tube to bedframe 32. As shown in FIG. 6, fastening member 16' includes primary clip 17'' which is preferably welded to the outer side of support tube 102 (102') to conform with the shape of the bedframes end and side rail 34. Fastening member 16' further includes backing clip 19 having a beveled portion 19' which creates a slot wherein the bedframe rail portion 34 is secured. Backing clip 19, as noted above, also includes hole 20' aligned with primary clip hole 17' such that, in operation, bolt 20 can be placed through the holes and be mated with securing knob 18. As shown more clearly in FIG. 7, primary clip 17'' is welded to the outer side portion of support tube 102 (102') to conform with the side and end rail portion of the bedframe. Hole 20' through which bolt 20 passes to be mated with securing knob 18, is also shown. As noted above, other means known to those of skill in the art can be used to attach fastening members 16' to bedframe 32.

Although the support tube is shaped to conform to at least one corner of bedframe 32 in each embodiment of apparatus 10, other shapes, and various sizes, as required by each user/patient are possible. For example, support tube 12, or 12', can be shaped to conform to two corners of bedframe 32. It is noted that whatever shape the support tube takes on, each of the fastening members 16 (16') will be attached to a different side or end rail 34 of bedframe 32 for stability. Other size and/or shape variations of the support tube which can be utilized include, for example, an intravenous fluid holding pole or a traction unit. Moreover, multiple support tubes may be used in combination, for example, as a food tray and/or phone table. It should also be noted that manual support apparatus 10 can be attached to any part of bedframe 32 to address any patient's particular needs.

The present invention will be further illustrated by the following example, which is intended to be illustrative in nature and is not to be construed as limiting the scope of the invention.

EXAMPLE

One suitable construction of a manual support apparatus having a shape and design substantially in accordance with the present invention is provided by the following combination of elements.

A manual support apparatus, which can be installed on a standard hospital bedframe is provided. The manual support apparatus includes a support tube made of 18 gauge stainless steel tubing having a 1 inch outside diameter. The stainless steel tubing, having a length of approximately 90 inches, is processed by providing three bends of approximately 90°. Two bends provide leg portions at both ends of the tubing of approximate equal length, while a center bend provides an elbow which generally conforms to the corner of the bedframe. Two fastening members are welded to the end portions of the stainless steel support tube. The fastening members include L-shaped primary clips which are made from 3/16 inch thick stainless steel plates which are approximately $3\frac{3}{4}$ inch in width, $2\frac{1}{2}$ inches in height and have an angled (or bent) portion of approximately $\frac{3}{4}$ inch. The primary clips also include a $\frac{1}{2}$ inch diameter hole, which are centered near the clips' base. Steel backing clips are also provided, having a thickness of about $\frac{1}{8}$ inch, a width of about $2\frac{1}{4}$ inches, and a height of about $2\frac{1}{2}$ inches. The backing clips have corresponding $\frac{3}{8}$ inch square holes, which are aligned with the primary clips' hole. Two $\frac{3}{8}$ inch steel carriage bolts are provided, and are placed through the backing clips and primary clips' holes, and are mated with threaded 5-star knobs on the outer portion of the primary clips. When assembled and attached to an angled bedframe, the angled support apparatus provides users with a secure and stable method to transfer into and out of bed independently while enhancing in-bed mobility.

The foregoing detailed description has been given for clearness of understanding only, and unnecessary limitations are not to be construed therefrom. The invention is not to be limited to the exact details shown and described since obvious modifications will occur to those skilled in the art, and any departure from the description herein that conforms to the present invention is intended to be included within the scope of the claims.

What is claimed is:

1. A manual support apparatus attachable to a bedframe, comprising:

a support tube shaped to conform to at least one corner of said bedframe, and having at least two legs;

at least two fastening members secured to said support tube legs, and shaped to conform with side and end rail portions of said bedframe; and means for attaching said fastening members to said bedframe, including backing clips which, with said fastening members, form a slot wherein said bedframe rail portions are secured.

2. The manual support apparatus of claim 1 wherein said bedframe is a hospital bedframe.

3. The manual support apparatus of claim 1 wherein said support tube is shaped such that each of said fastening members is attached to a different side of said bedframe.

4. The manual support apparatus of claim 1, wherein said fastening members are L-shaped clips.

5. The manual support apparatus of claim 1 wherein said fastening members are rigidly secured to said support tube legs.

6. The manual support apparatus of claim 5 wherein said fastening members are welded to said support tube legs.

7. The manual support apparatus of claim 1 wherein said fastening members are secured to base portions of said support tube legs.

8. The manual support apparatus of claim 1 wherein said means for attaching said fastening members to said bedframe are part of said fastening members.

9. The manual support apparatus of claim 1 wherein said means for attaching said fastening members to said bedframe further includes bolts and securing knobs.

10. A manual support apparatus attachable to a bedframe, comprising:

a support tube having at least two portions, said portions adapted for assembly with each other, such that said support tube, when assembled, is shaped to conform to at least one corner of said bedframe, and has at least two legs;

at least two fastening members secured to said support tube legs, and shaped to conform with side and end rail portions of said bedframe; and means for attaching said fastening members to said bedframe, including backing clips which, with said fastening members, form a slot wherein said bedframe rail portions are secured.

11. The manual support apparatus of claim 10 wherein said bedframe is a hospital bedframe.

12. The manual support apparatus of claim 10 wherein said support tube, when assembled, is shaped such that each of said fastening members is attached to a different side of said bedframe.

13. The manual support apparatus of claim 10, wherein said fastening members are L-shaped clips.

14. The manual support apparatus of claim 10 wherein said means for attaching said fastening members to said bedframe further includes bolts and securing knobs.

15. A manual support apparatus attachable to a bedframe, comprising;

a support tube shaped to conform to at least one corner of said bedframe;

at least two fastening members secured to said support tube, and shaped to conform with side and end rail portions of said bedframe; and means for attaching said fastening members to said bedframe, including backing clips which, with said fastening members, form a slot wherein said bedframe rail portions are secured.

16. The manual support apparatus of claim 15 wherein said bedframe is a hospital bedframe.

17. The manual support apparatus of claim 15 wherein said support tube is shaped such that each of said fastening members is attached to a different side of said bedframe.

18. The manual support apparatus of claim 15 wherein said means for attaching said fastening members to said bedframe further includes bolts and securing knobs.

* * * * *